US006892805B1

(12) United States Patent
Valensa

(10) Patent No.: US 6,892,805 B1
(45) Date of Patent: May 17, 2005

(54) FLUID FLOW DISTRIBUTION DEVICE

(75) Inventor: Jeroen Valensa, New Berlin, WI (US)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 10/818,292

(22) Filed: Apr. 5, 2004

(51) Int. Cl.[7] ..... F28F 9/02; F28F 27/00
(52) U.S. Cl. ..... 165/174; 165/173; 165/96
(58) Field of Search ..... 165/173–175, 165/158–159, 143, 80.5, 80.2, 96, 111, 115; 62/525, 504; 137/271, 573

(56) References Cited

U.S. PATENT DOCUMENTS 3,646,963 A * 3/1972 Klee ..... 137/884
3,760,844 A * 9/1973 Olson et al. ..... 137/884
3,765,441 A * 10/1973 Chang ..... 137/271
3,991,786 A * 11/1976 Olson ..... 137/561 R
5,241,839 A * 9/1993 Hughes ..... 62/515
5,242,016 A * 9/1993 Voss et al. ..... 165/174
5,415,223 A * 5/1995 Reavis et al. ..... 165/98
6,167,713 B1 * 1/2001 Hartfield et al. ..... 62/115
6,494,253 B2 * 12/2002 Gotou et al. ..... 165/115

* cited by examiner

*Primary Examiner*—Tho v Duong
(74) *Attorney, Agent, or Firm*—Wood, Phillips, Katz, Clark & Mortimer

(57) ABSTRACT

A fluid flow distribution device (10) is provided for use in a heat exchanger (12) having multiple heat exchange units (14) that receive a fluid flow (18) from an fluid inlet (16). The device includes a plurality of tortuous flow paths (31) to direct distributed portions of the fluid flow (18) from the inlet (16) to the heat exchange units (14). Each tortuous flow path (31) is defined by a pair of flow chamber plates (24,26), and an orifice plate (28) sandwiched between the flow chamber plates (24,26). Each tortuous flow path (31) includes a series (34) of orifices (36) extending through the orifice plate (28), a first pattern (38) of first flow chambers (40) formed in one of the flow chamber plates (24,26) and aligned with sequential pairs of the orifices (36), and a second pattern (42) of second flow chambers (44) formed in the other of the flow chamber plates (24,26) and offset with respect to the first pattern (38) and the pairs of orifices (36).

32 Claims, 4 Drawing Sheets

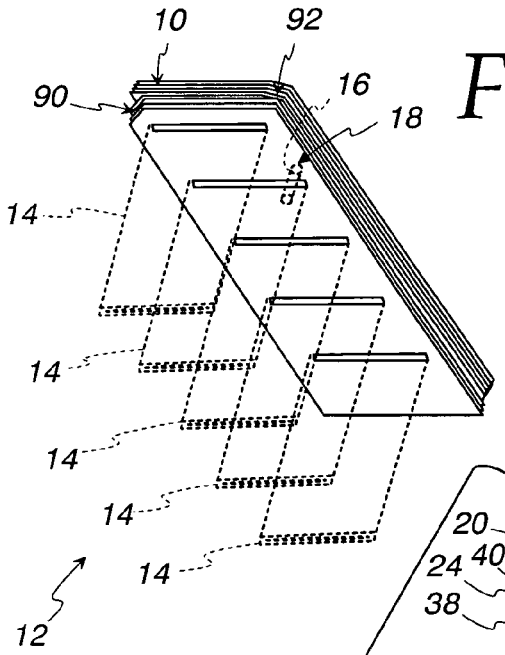
Fig. 1
Fig. 2
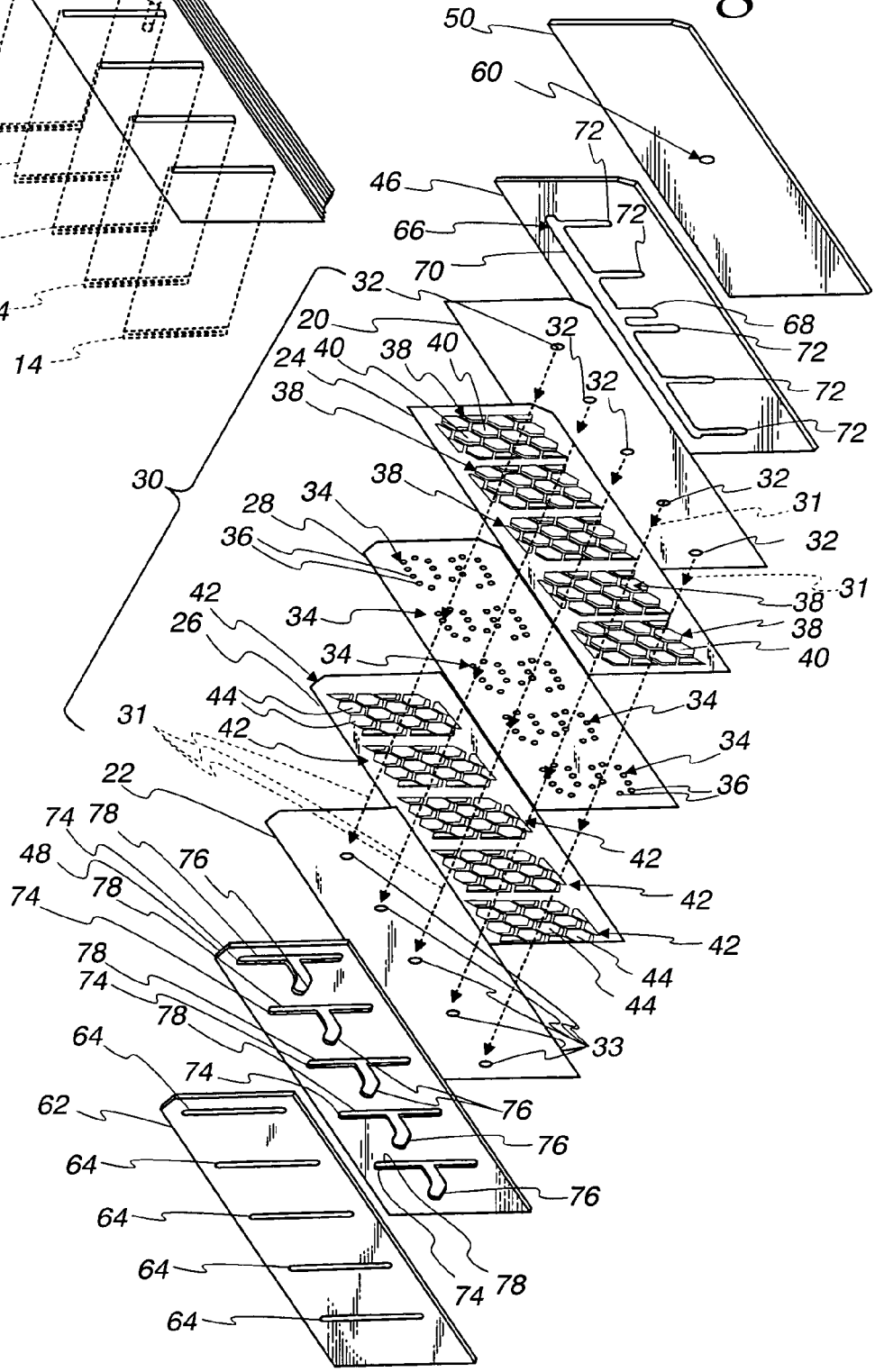

FLUID FLOW DISTRIBUTION DEVICE

FIELD OF THE INVENTION

This invention relates to devices that distribute fluid flow from a common source to a plurality of flow paths, and in more particular applications to such devices as used in heat exchangers to equally distribute a fluid flow among a plurality of parallel heat exchange flow paths or units for passage therethrough in heat exchange relation with one or more other fluids.

BACKGROUND OF THE INVENTION

There are many fluid components that require a desired distribution, generally equal, of a fluid flow among multiple flow paths from a common fluid flow source. One example of such fluid flow components are heat exchangers, and particularly heat exchangers that act as evaporators or vaporizers. Because the heat absorbed by the liquid fluid that is being evaporated or vaporized is mostly latent heat, it is typical for the majority of length of such vaporizing heat exchangers to be occupied by a two phase fluid. Unlike some heat exchangers, for example condensers, the flow distribution in the vaporizers is not self-correcting and different flow conditions can produce the same pressure drop (i.e., high mass flow with low quality change or low mass flow with super heat) and can therefore coexist in parallel flow paths. This can result in heat fluxes that vary significantly from flow path to flow path (i.e., from tube to tube) and can negatively affect performance and stability in the vaporizer.

One very specific example of vaporizers are those that are used in the fuel processing system for Proton Exchange Membrane (PEM) fuel cells wherein a gaseous mixture of water vapor and hydrocarbon are chemically reformed at high temperature to produce a hydrogen-rich flow stream commonly referred to a reformate. To produce this high temperature water vapor and hydrocarbon stream, it is typical to either produce steam from liquid water for the humidification of a gaseous hydrocarbon fuel, such as methane, or to vaporize a water and liquid hydrocarbon mixture. Often, the heat source for vaporization is a hot gas, such as the reformate or combusted anode tail gas, which is already present in the fuel cell system and has substantial heat available for the required vaporization of the liquid water and/or liquid hydrocarbon. In order to make the vaporizing heat exchanger as compact as possible, it is known to flow the fluid to be vaporized in multiple parallel flow paths or passages in order to maximize the surface area to which the fluid is exposed within a given volume. The multiple parallel flow paths require that the liquid phase fluid entering the heat exchanger be distributed evenly among the parallel flow paths. While there are vaporizers suitable for use in such systems, there is always room for improvement. For example, some such vaporizers do not lend themselves to be readily or easily manufactured from a variety of materials, such as out of aluminum. One such solution has been proposed by Reinke et al in U.S. application Ser. No. 10/145,531, filed May 14, 2002 and published as US-2003-0215679 Al which shows a brazed stainless steel, stacked-plate type of heat exchanger. According to this proposal, an inlet section is provided by overlapping a pair of slotted sheets with each sheet having very narrow slots that provide a relatively high pressure drop to each of the parallel flow path in the remainder of the heat exchanger, which results in good distribution of the fluid flow among the parallel flow paths. However, because larger amounts of brazing alloy would tend to clog the narrow channels or slots in the sheets, this construction does not easily lend itself to some materials, such as aluminum, that require a larger amount of brazing alloy in comparison to stainless steel.

SUMMARY OF THE INVENTION

A fluid flow distribution device is provided for use in a heat exchanger having multiple parallel flow paths or heat exchange units that receive a fluid flow from an fluid inlet. The device includes a plurality of tortuous flow path units to direct the fluid flow from the inlet to the heat exchange units. The units lie in a common plane. Each tortuous flow path unit includes a pair of flow chamber plates, an orifice plate sandwiched between the flow chamber plates, and a tortuous flow path. Each tortuous flow path includes a series of orifices extending through the orifice plate, a first pattern of first flow chambers formed in one of the flow chamber plates, and a second pattern of second flow chambers formed in the other of the flow chamber plates and offset with respect to the first pattern.

In one form of the invention, the first pattern is aligned with sequential pairs of the orifices and the second pattern is offset with respect to the first pattern and the pairs of orifices. Each pair of the orifices is aligned with one of the first flow chambers and with a pair of the second flow chambers to direct the fluid flow to the one of the first chambers from one of the pair of the second chambers via one of the orifices of the pair of orifices and from the one of the first chambers to the other of the pair of the second chambers via the other orifice of the pair of orifices such that the fluid flow travels along the tortuous flow path passing sequentially through the series of orifices while alternating between the first and second flow chambers.

According to one form of the invention, the first and second patterns of flow chambers are aligned relative to each other and relative to the series of orifices such that the tortuous flow path extends from an initial one of the flow chambers to a final one of the flow chambers, alternating between the first and second flow chambers and passing through one of the orifices each time the tortuous flow path enters or leaves one of the first and second flow chambers.

In one form, the first and second flow chambers of each of the tortuous flow path units are open to both sides of the corresponding flow chamber plate and are enclosed by the orifice plate on one side of each of the flow chamber plates and by respective end plates on the opposite sides of the flow chamber plates. In a further form, one of the end plates has an inlet opening connected to the fluid inlet and aligned with an initial one of the first and second flow chambers to direct the fluid flow from the fluid inlet to the tortuous flow path; and one of the end plates has an outlet opening aligned with a final one of the first and second flow chambers and connected to at least one of the heat exchange units to direct the fluid flow from the tortuous flow path to the at least one of the heat exchange units. In yet a further form, the inlet and outlet openings are not in the same end plate. In one form, the fluid flow distribution device further includes a pair of flow manifold plates, and the plurality of tortuous flow path units are sandwiched between the flow manifold plates, with one of the flow manifold plates including a flow path channel aligned with the fluid inlet and each of the inlet openings in each of the tortuous flow path units to direct the fluid flow from the fluid inlet to each of the inlet openings, and the other of the flow manifold plates including a plurality of discrete flow path channels, each of the discrete flow path channels aligned with one of the outlet openings and the associated at least one of the exchange units to direct the fluid flow from the one of the outlet openings to the associated at least one of the heat exchange units. In a further form, the fluid flow distribution device further includes an inlet plate overlaying the one of the flow manifold plates and including an inlet port therein aligned with the fluid inlet and the flow path channel, and a header plate overlaying the other of the flow manifold plates and including a plurality of openings, each opening receiving one of the heat exchange units and aligned with one of the discrete flow channels.

In one form of the invention, the series of orifices of all of the tortuous flow path units are located in a single orifice plate, the first patterns of all of the plurality of tortuous flow path units are located in a single flow chamber plate; and the second patterns of all of the plurality of tortuous flow path units are located in a single flow chamber plate.

In accordance with one form of the invention, a fluid flow distribution device is provided for use in a heat exchanger having multiple heat exchange units that receive a fluid flow from an fluid inlet. The device includes a pair of end plates, a pair of flow chamber plates sandwiched between the end plates, an orifice plate sandwiched between the flow chamber plates, and a plurality of tortuous flow paths defined by the orifice plate and the flow chamber plates sandwiched between the end plates. Each of the tortuous flow paths includes a series of orifices extending through the orifice plate, a first pattern of first flow chambers formed in one of the flow chamber plates, and a second pattern of second flow chambers formed in the other of the flow chamber plates. The first and second patterns of flow chambers are aligned relative to each other and relative to the series of orifices such that the tortuous flow path extends from an initial one of the flow chambers to a final one of the flow chambers, alternating between the first and second flow chambers and passing through one of the orifices each time the tortuous flow path enters or leaves one of the first and second flow chambers.

In one form, the first and second flow chambers of each of the tortuous flow path units are open to both sides of their respective flow chamber plate and are enclosed by the orifice plate on one side of each of the flow chamber plates and by the end plates on the opposite side of each of the flow chamber plates. In a further form, one of the end plates has a plurality of inlet openings equal in number to the plurality of tortuous flow paths, with each of the inlet openings connected to the fluid inlet and aligned with an initial one of the first and second flow chambers of one of the tortuous flow paths to direct the fluid flow from the fluid inlet to the tortuous flow path, and one of the end plates has a plurality of outlet openings equal in number to the plurality of tortuous flow paths, with each of the outlet opening aligned with a final one of the first and second flow chambers of one of the tortuous flow paths and connected to at least one of the heat exchange units to direct the fluid flow from the tortuous flow path to the at least one of the heat exchange units. In yet a further form, the inlet and outlet opening are not in the same end plate. In one form, the fluid flow distribution device further includes a pair of flow manifold plates, the end plates are sandwiched between the flow manifold plates, one of the flow manifold plates includes a flow path channel aligned with the fluid inlet and each of the inlet openings to direct the fluid flow from the fluid inlet to each of the inlet openings, and the other of the flow manifold plates includes a plurality of discrete flow path channels, with each of the discrete flow path channels being aligned with one of the outlet openings and the corresponding at least one of the exchange units to direct the fluid flow from the outlet opening to the corresponding at least one of the heat exchange units. In a further form, the fluid flow distribution device further includes an inlet plate overlaying the one of the flow manifold plates and including an inlet port therein aligned with the fluid inlet and the flow path channel, and a header plate overlaying the other of the flow manifold plates and including a plurality of openings, with each opening receiving one of the heat exchange units and being aligned with one of the discrete flow channels.

According to one form of the invention, the first and second flow chambers all have the same shape and size. In a further form, the first and second flow chambers are hexagonal shaped.

In one form, the first and second flow chamber plates are identical in construction.

In accordance with one form of the invention, the series of orifices are arranged in a serpentine pattern.

Other objects, advantages, and features of the invention will be understood from a complete reading of the entire specification, including the appended drawings, claims and abstract.

BRIEF DESCRIPTION OF THE DRAWINGS

FIG. 1 is a perspective view showing a fluid flow distribution device embodying the present invention;

FIG. 2 is an exploded view of the fluid distribution device of FIG. 1;

DETAILED DESCRIPTION OF THE PREFERRED EMBODIMENT

Figure 3:
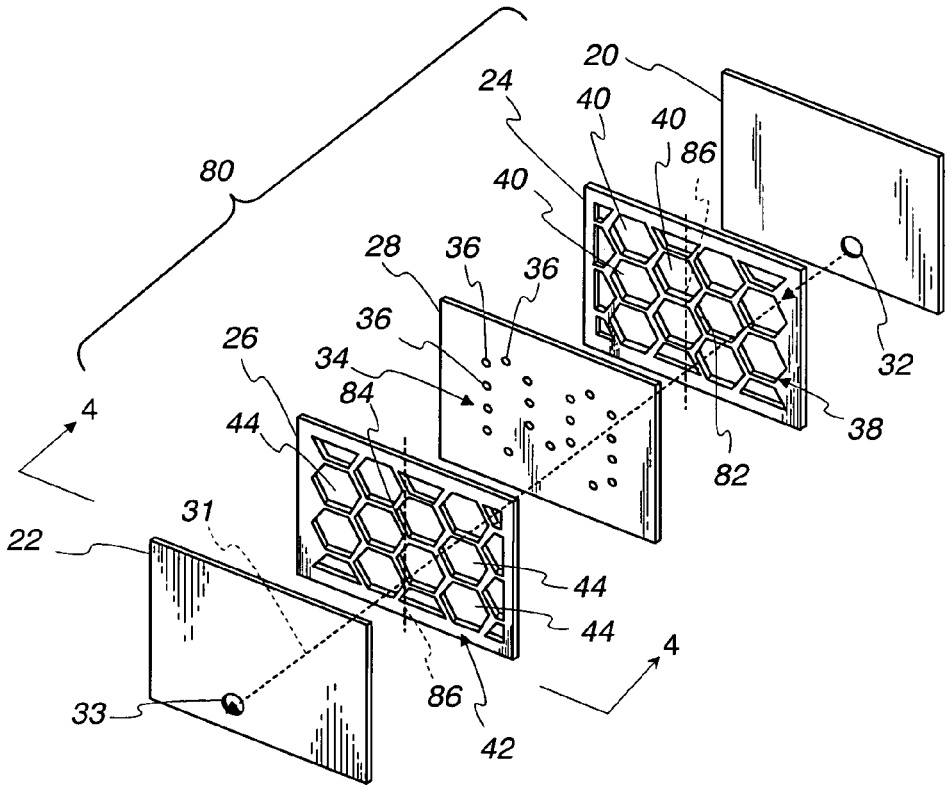
FIG. 3 is an exploded view showing portions of several selected components from FIG. 2.

With reference to FIG. 1, a fluid flow distribution device 10 is shown in connection with a heat exchanger 12 having multiple parallel heat exchange flow paths or units 14 shown in the form of extruded, flattened multiport tubes (shown in phantom with only partial lengths). The heat exchanger 12 further includes a fluid inlet 16 (shown in phantom) that receives a fluid flow 18 that should, under ideal conditions, be equally distributed among the plurality of heat exchange units 14. The distributed fluid flow 18 passes through the interior ports of the tubes 14 for the transfer of heat to another fluid flow that is in heat exchange relation with the exterior of the tubes 14, typically through some suitable type of fin (not shown), such as serpentine fins extending between adjacent tubes or plate fins extending across all of the tubes 14. A collection manifold (not shown) for the fluid flow 18 will normally be provided on the opposite end of the heat exchange units 14 to collect the distributed fluid flow 18 from the heat exchange units 14.

It should be appreciated that while the fluid flow distribution device 10 is shown herein in connection with heat exchange flow paths or units 14 shown in the form of extruded multiport tubes, the fluid flow distribution device according to the invention will find use with any other suitable form of heat exchanger or heat exchange flow path or unit, many of which are known, such as for example, welded tubes, drawn cup or stacked-plate type constructions, and/or bar-plate type constructions. Furthermore, while the construction illustrated in FIG. 1 is shown in connection with five heat exchange units 14, the fluid flow distribution device 10 according to the invention can find use in heat exchangers having two or more heat exchange flow paths or units that require the fluid flow to be distributed therebetween. Accordingly, no limitation is intended to a particular type of heat exchange flow path or unit or to a specific number of such flow paths or units, unless expressly recited in the claims.

The fluid flow distribution device 10 of FIG. 1 is illustrated in the form of a stacked, brazed plate construction, which is shown exploded in FIG. 2. The flow distribution device 10 includes a pair of end plates 20,22, a pair of flow chamber plates 24,26 sandwiched between the end plates 20,22, and an orifice plate 28 sandwiched between the flow chamber plates 24,26. Together the plates 20, 22, 24, 26, and 28 form a multiple tortuous flow path component 30 having a sandwiched, plate type construction and defining a plurality of tortuous flow paths, illustrated very schematically in FIG. 2 by dashed arrow lines 31, with each flow path 31 corresponding to one of the tubes 14 and extending from an inlet opening 32 in the end plate 20 to an outlet opening 33 in the end plate 22. Each of the tortuous flow paths 31 includes a series 34 of orifices 36 extending through the orifice plate 28, a first pattern 38 of flow chambers 40 formed in the flow chamber plate 24, and a second pattern 42 of second flow chambers 44 formed in the other flow chamber plate 26. As will be explained in more detail below, for each of the tortuous flow paths 31, the first and second patterns 38 and 42 of first and second flow chambers 40 and 44 are aligned relative to each other and with the series 34 of orifices 36 so that the tortuous flow path 31 passes in an alternating fashion between the first and second flow chambers 40,44 and sequentially through the orifices 36, passing through one of the orifices 36 each time the tortuous flow path 31 enters or leaves one of the first and second flow chambers 40 and 44.

The illustrated embodiment of the flow distribution device 10 in FIG. 2 further includes a pair of flow manifold plates 46 and 48, with the tortuous flow path component 30 sandwiched therebetween, an inlet plate 50 overlaying the flow manifold plate 36 and including an inlet port 60 of the fluid inlet 16 extending therethrough, and a header plate 62 overlaying the other manifold plate 48 and including a plurality of openings 64 in the form of slots, with each opening 64 receiving one of the heat exchanger units 14. The flow manifold plate 46 includes a flow path channel 66 in the form of a multi-legged slot extending through the plate 46. The channel 66 includes a leg portion 68 that extends from a manifold portion 70 to align with the inlet port 60 to direct the fluid flow from the inlet port 60 to the manifold portion 70, and a plurality of additional leg portions 72, with each portion 72 extending from the manifold portion 70 into alignment with one of the inlet openings 32 in the end plate 20 to direct a distributed portion of the fluid flow 18 thereto. The manifold plate 48 includes a plurality of discrete flow path channels 74 in the form of legged slots extending therethrough; with each of the channels 74 including a leg portion 76 aligned with one of the outlet openings 33 and extending from an elongate portion 78 aligned with one of the openings 64 to transfer a distributed portion of the fluid flow 18 from the outlet opening 33 to the opening 64.

With reference to FIG. 3, the components that make up one of the tortuous flow paths 32 (again shown very schematically by the dashed arrowed line in FIG. 3) are shown enlarged and broken away from the other tortuous flow path 32. In this regard, it should be noted that the portions of the plates 20,22,24,26,28 shown in FIG. 3 can be considered to form individual tortuous flow path units 80, with each of the portions shown in FIG. 3 being part of a common plate such as shown in FIG. 2, or, alternatively, formed as individual components, such as shown in FIG. 3, that lie in a common plane with other individual tortuous flow path units 80 constructed from similar individual components to define additional tortuous flow paths 32. As seen in FIG. 3, each of the flow chambers 40,44 have an identical hexagonal shape defined by uniformly thin webs 82,84 that extend between the flow chambers 40,44, respectively, to define the respective first and second patterns 38,42. In this regard, it should be noted that in the illustrated embodiment, the patterns 38 and 42 are identical, but are flipped 180° about an axis 86 relative to each other so as to offset the patterns 38 and 42 relative to each other in the assembled state. The series 34 of orifices 36 is provided in a serpentine shape or pattern so as to provide the desired alignment, best seen in FIG. 4, with each of the flow chambers 40,44 in the respective patterns 38,42. More specifically, sequential pairs (identified in FIG. 4 as orifices 36A and 36B in each pair) of the orifices 36 are aligned with each of the first flow chambers 40 and with a pair of the second flow chambers 44.

Figure 4:
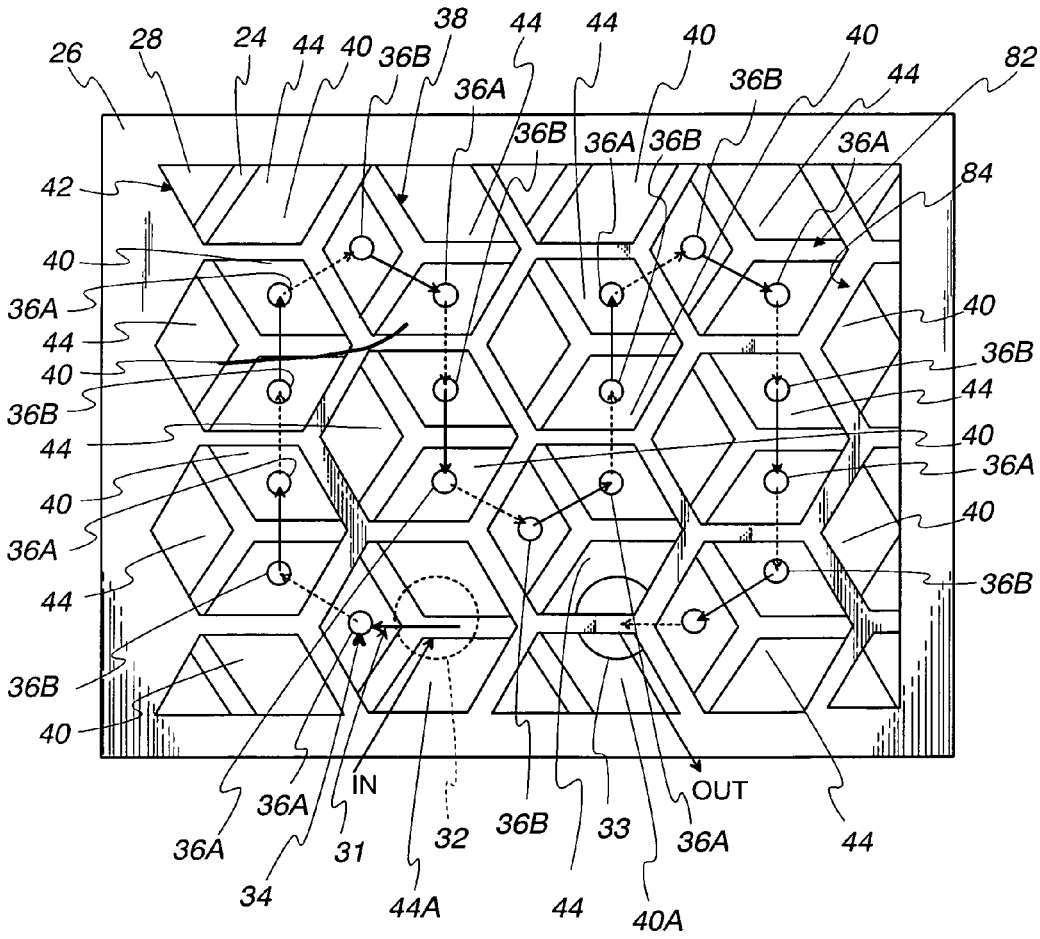
FIG. 4 is a somewhat diagrammatic view taken from line 4—4 in FIG. 3.

The tortuous flow path 31 is best understood in connection with FIG. 4, which shows the tortuous flow path 31 in the form of solid arrows and dashed arrows, with the solid arrows representing flow through the flow chambers 44 of the second pattern 42 and the dashed arrows representing flow through the flow chambers 40 of the first pattern 38 (shown solid in FIG. 4 for purposes of illustration). In the embodiment shown in FIG. 4, the tortuous flow path extends from an initial one 44A of the flow chambers 44 to a final one 40A of the flow chambers 40, alternating between the first and second flow chambers 40,44 while passing sequentially through the orifices 36. More specifically, the tortuous flow path 31 enters the initial flow chamber 40A via the inlet opening 32 (shown in phantom for purposes of illustration), flows through the flow chamber 44A to a first one of the orifices 36A, passes through the orifice 36A into one of the flow chambers 40, flows through the one of the flow chambers 40 to another one of the orifices 36B (the other orifice of the pair of orifices associated with the one of the flow chambers 40), passes through the orifice 36B into another one of the flow chambers 44, and so on and so on, passing through one of the orifices 36 each time the tortuous flow path 31 enters or leaves one of the flow chambers 40,44 until the tortuous flow path enters the final flow chamber 40A and exits the tortuous flow path unit 80 via the outlet opening 33. To state this in other terms, the flow chambers 40,44 provide a flow paths between each of the orifices 36 of the series 34 so that the fluid flows in a sequential manner through the orifices 36 of the tortuous flow path 31.

The liquid pressure drop in each of the tortuous flow paths 31 is accomplished by a velocity head loss and a contraction and expansion head loss at each of the orifices 36, as opposed to a frictional loss by flowing through a relatively long, small area flow channel as in some previously proposed designs, such as the Reinke et al application discussed in the Background section. The pressure drop through each of the tortuous flow paths 31 can be adjusted by varying the size and number of orifices 36 in the series 34.

While any suitable material and joining method can be used, preferably, each of the plates 20,22,24,26,28,46,48,50, 62 are made of aluminum and are stacked and brazed together. It is also preferred that the orifice plate 28 be an unclad plate and that each of the flow chamber plates 24,26 be clad with brazing alloy on both sides. Each of the end plates 20,22 is preferably unclad on the side that faces the respective flow chamber plate 24, 26, but may optionally be clad with brazing alloy on the opposite side so as to form a brazed joint with the corresponding manifold plate 46,48. Alternatively, each of the end plates 20,22 can be unclad on both sides, with each of the manifold plates 46,48 being clad with brazing alloy on both of their sides so as to form brazed joints with the corresponding end plates 20,22 and corresponding inlet plate 58 or header plate 62. It should be appreciated that because the first and second patterns 38,42 of flow chambers 40,44 provide a large percentage of open area with uniformly thin webs 82,84 that face the orifice plate 28, the concerns for clogging each of the tortuous flow paths 31 with braze are minimized. This is particularly true because the design reduces the amount of braze alloy that is located close to each of the orifices 36 in the orifice plate 28. To state this in other terms, because the face area of each of the flow chamber plates 24,26 has been greatly reduced by the first and second patterns 38,42 of flow chambers 40,44, and the braze alloy used to join the plates 24,26 to the orifice plate 28 is found only on the faces of the flow chamber plates 24,26, the amount of braze alloy present for clogging each of the tortuous flow paths 31, and in particular the orifice holes 36, has been greatly reduced. In this regard, controlled brazed atmosphere trials were performed on the patterns shown in FIG. 4 to produce five test pieces with five different diameters for the orifice holes 36 ranging from 0.031 inch to 0.052 inch. In all cases, the brazing was successful and the orifice holes 36 remained open.

Figure 5:
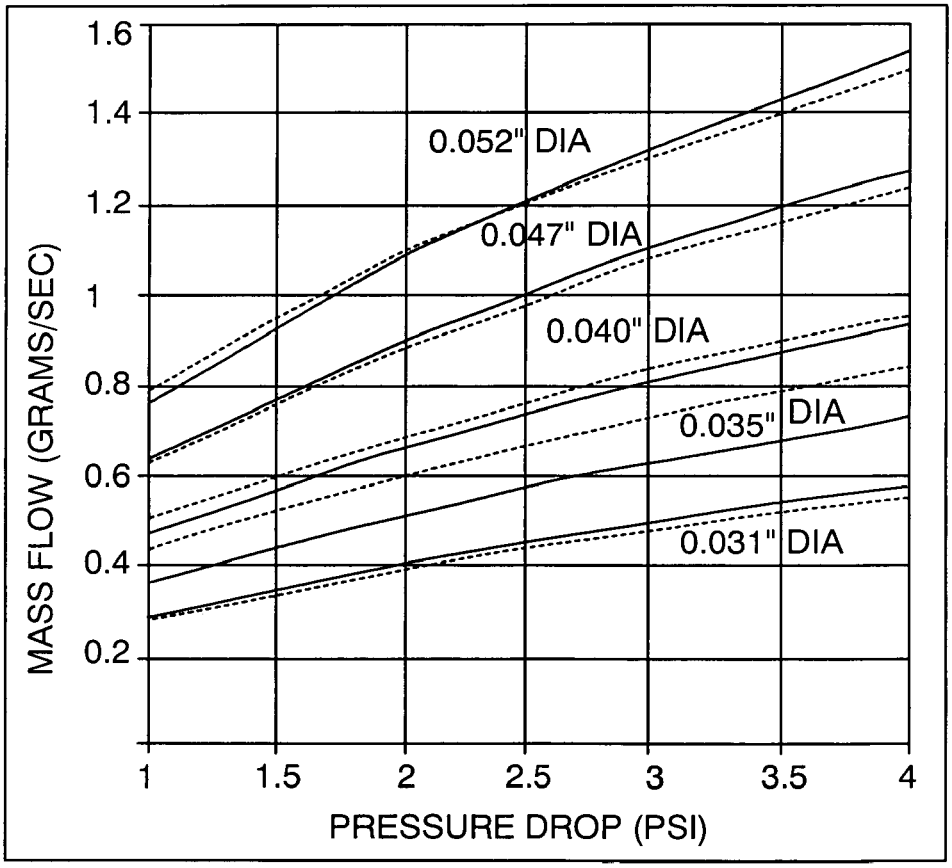
FIG. 5 is a graph illustrating the pressure drop versus mass flow characteristics for the device of FIG. 1.

FIG. 5 illustrates the results of mass flow versus pressure drop testing using liquid water performed on each of the above-referenced test pieces, with the test results shown in comparison to the predicted performance accordance to calculations (predicted performance shown by solid lines, test results shown by dashed lines). The predicted pressure drop in (PSI) versus mass flow rate in (grams/sec) was calculated as consisting of two velocity head losses for each of the orifices 36, with the first being a full velocity head loss for the flow in the plane of the plates 24,26,28 and the second velocity head loss being the full head loss for the flow through each of the orifices 36. The flow area for the first head loss was approximated to be the surface of a cylinder having a diameter equal to the diameter of the orifices 36 and a height equal to the thickness of one of the flow chamber plates 24,26. The first head loss was then calculated as $m^2/(2\rho A_1^2)$, where m is the mass flow rate, p is the density of water and $A_1$ is the calculated flow area. The second head loss was calculated as $m^2/(2\rho A_2^2)$, where $A_2$ is the area of a circle with a diameter equal to the diameter of the orifice 36. The total predicted pressure drop was calculated as the sum of these two head losses multiplied by the number of orifices 36 in the series 34 and then corrected with a loss coefficient of 20. Each of the test pieces was tested by forcing water at various inlet pressures through the test piece with the outlet opening 33 being at atmospheric pressure. The water passing through the test piece was collected for a fixed time duration and was weighed to determine the mass flow rate at that pressure. As seen in FIG. 5, there is a good correlation between the test results and the predicted values when a loss coefficient of two was applied to the predicted values. As also seen in FIG. 5, the design works well over a range of flow velocities, including low flow velocities.

With reference to FIG. 2, in a highly preferred construction, the plates 24,26 are identical to each other and are simply rotated 180° about their longitudinal axes with respect to each other before they are brazed to the orifice plate 28. This results in the same face of the identical flow chamber plates 24,26 being brazed against the corresponding face of the orifice plate 28. Similarly, the end plates 20,22 are identical in construction and are rotated 180° about their longitudinal axes with respect to each other so that the same face of each plate 20,22 is brazed to the corresponding face of the corresponding flow chamber plate 24,26. To achieve this orientation during assembly, an upper corner of each of the plates 20,22,24,26 is chamfered and then aligned with similar chamfers on each of the opposite upper corners of the orifice plate 28. Similar chamfers are provided on the plates 46,48,50,62 so that in the assembled state, you have aligned chamfers 90 and 92 for each half of the fluid flow distribution device, thereby assuring proper assembly of the device 10.

It should be appreciated that while hexagonal shaped flow chambers 40,44 are shown, other shapes, such as, for example, circles, rectangles, squares, ovals, triangles, trapezoids, octagons, etc., may be used for forming the first and second patterns 38,42. Similarly, while it is preferred for the patterns 38,42 to be identical with identically shaped flow chambers 40,44, in some applications it may be desirable for the patterns 38,42 to be different while utilizing the same shape flow chambers 40,44 or while utilizing different shaped flow chambers 40,44. Additionally, it should be appreciated that while the inlet and outlet openings 31,33 are shown in FIGS. 3 and 4 as being located in one of the end plates 20,22 or the other, in some applications it may be desirable for the inlet and outlet openings 31,33 to be located in the same end plate 20,22 which would result in the initial and final flow chambers of the tortuous flow path 31 being located in the same flow chamber pattern 38 or 42, as opposed to having the initial flow chamber 40 or 44 being located in one of the patterns 38,42, and the final flow chamber 40 or 44 being located in the other flow pattern 38,42.

It has been found that by providing a relatively high pressure drop in the inlet region of each of a plurality of parallel heat exchange flow paths or units, good distribution of a fluid flow can be achieved among the parallel heat exchange flow paths or units. It should be appreciated that fluid flow distribution devices according to the invention can provide this benefit in a structure that can reduce the potential for clogging in comparison to other proposed designs.

What is claimed is:

1. A fluid flow distribution device for use in a heat exchanger having multiple heat exchange units that receive a fluid flow from a fluid inlet; the device comprising:

a plurality of tortuous flow path units to direct the fluid flow from the inlet to said heat exchange units, said tortuous flow path units lying in a common plane, each tortuous flow path unit comprising a pair of flow chamber plates, an orifice plate sandwiched between the flow chamber plates, and a tortuous flow path, the tortuous flow path comprising a series of orifices extending through said orifice plate, a first pattern of first flow chambers formed in one of said flow chamber plates and aligned with sequential pairs of said orifices, and a second pattern of second flow chambers formed in the other of said flow chamber plates and offset with respect to said first pattern and said pairs of orifices, each pair of said orifices aligned with one of said first flow chambers and with a pair of said second flow chambers to direct said fluid flow to said one of said first chambers from one of said pair of said second chambers via one of the orifices of the pair of said orifices and from said one of said first chambers to the other of said pair of said second chambers via the other orifice of said pair of said orifices such that the fluid flow travels along said tortuous flow path passing sequentially through said series of orifices while alternating between said first and second flow chambers.

2. The fluid flow distribution device of claim 1 wherein said first and second flow chambers of each of the tortuous flow path units are open to both sides of the corresponding flow chamber plate and are enclosed by said orifice plate on one side of each of the flow chamber plates and by respective end plates on the opposite sides of the flow chamber plates.

3. The fluid flow distribution device of claim 2 wherein:

one of said end plates has an inlet opening connected to said fluid inlet and aligned with an initial one of said first and second flow chambers to direct the fluid flow from the fluid inlet to the tortuous flow path; and one of said end plates has an outlet opening aligned with a final one of said first and second flow chambers and connected to at least one of said heat exchange units to direct the fluid flow from the tortuous flow path to said at least one of said heat exchange units.

4. The fluid flow distribution device of claim 3 wherein said inlet and outlet openings are not in the same end plate.

5. The fluid flow distribution device of claim 4 further comprising a pair of flow manifold plates, and where the plurality of tortuous flow path units are sandwiched between the flow manifold plates, one of said flow manifold plates including a flow path channel aligned with the fluid inlet and each of the inlet openings in each of the tortuous flow path units to direct the fluid flow from the fluid inlet to each of the inlet openings, the other of the flow manifold plates including a plurality of discrete flow path channels, each of said discrete flow path channels aligned with one of said outlet openings and the associated at least one of said exchange units to direct the fluid flow from the one of said outlet openings to the associated at least one of said heat exchange units.

6. The fluid flow distribution device of claim 5 further comprising:

an inlet plate overlaying said one of said flow manifold plates and including an inlet port therein aligned with said fluid inlet and said flow path channel; and a header plate overlaying said other of said flow manifold plates and including a plurality of openings, each opening receiving one of said heat exchange units and aligned with one of said discrete flow channels.

7. The fluid flow distribution device of claim 1 wherein:

the series of orifices of all of the tortuous flow path units are located in a single orifice plate;

the first patterns of all of said plurality of tortuous flow path units are located in a single flow chamber plate; and the second patterns of all of said plurality of tortuous flow path units are located in a single flow chamber plate.

8. The fluid flow distribution device of claim 1 wherein said first and second flow chambers all have the same shape and size.

9. The fluid flow distribution device of claim 8 wherein said first and second flow chambers are hexagonal shaped.

10. The fluid flow distribution device of claim 8 wherein said first and second flow chamber plates are identical in construction.

11. The fluid flow distribution device of claim 8 wherein said series of orifices are arranged in a serpentine pattern.

12. A fluid flow distribution device for use in a heat exchanger having multiple heat exchange units that receive a fluid flow from a fluid inlet; the device comprising:

a plurality of tortuous flow path units to direct the fluid flow from the inlet to said heat exchange units, said tortuous flow path units lying in a common plane, each tortuous flow path unit comprising a pair of flow chamber plates, an orifice plate sandwiched between the flow chamber plates, and a tortuous flow path, the tortuous flow path comprising a series of orifices extending through said orifice plate, a first pattern of first flow chambers formed in one of said flow chamber plates, and a second pattern of second flow chambers formed in the other of said flow chamber plates, said first and second patterns of flow chambers aligned relative to each other and relative to said series of orifices such that the tortuous flow path extends from an initial one of the flow chambers to a final one of the flow chambers, alternating between the first and second flow chambers and passing through one of said orifices each time the tortuous flow path enters or leaves one of the first and second flow chambers.

13. The fluid flow distribution device of claim 12 wherein said first and second flow chambers of each of the tortuous flow path units are open to both sides of the corresponding flow chamber plate and are enclosed by said orifice plate on one side of each of the flow chamber plates and by respective end plates on the opposite sides of the flow chamber plates.

14. The fluid flow distribution device of claim 13 wherein:

one of said end plates has an inlet opening connected to said fluid inlet and aligned with an initial one of said first and second flow chambers to direct the fluid flow from the fluid inlet to the tortuous flow path; and one of said end plates has an outlet opening aligned with a final one of said first and second flow chambers and connected to at least one of said heat exchange units to direct the fluid flow from the tortuous flow path to said at least one of said heat exchange units.

15. The fluid flow distribution device of claim 14 wherein said inlet and outlet openings are not in the same end plate.

16. The fluid flow distribution device of claim 15 further comprising a pair of flow manifold plates, and wherein the plurality of tortuous flow path units are sandwiched between the flow manifold plates, one of said flow manifold plates including a flow path channel aligned with the fluid inlet and each of the inlet openings in each of the tortuous flow path units to direct the fluid flow from the fluid inlet to each of the inlet openings, the other of the flow manifold plates including a plurality of discrete flow path channels, each of said discrete flow path channels aligned with one of said outlet openings and the associated at least one of said exchange units to direct the fluid flow from the one of said outlet openings to the associated at least one of said heat exchange units.

17. The fluid flow distribution device of claim 16 further comprising:

an inlet plate overlaying said one of said flow manifold plates and including an inlet port therein aligned with said fluid inlet and said flow path channel; and a header plate overlaying said other of said flow manifold plates and including a plurality of openings, each opening receiving one of said heat exchange units and aligned with one of said discrete flow channels.

18. The fluid flow distribution device of claim 12 wherein:

the series of orifices of all of the tortuous flow path units are located in a single orifice plate;

the first patterns of all of said plurality of tortuous flow path units are located in a single flow chamber plate; and the second patterns of all of said plurality of tortuous flow path units are located in a single flow chamber plate.

19. The fluid flow distribution device of claim 12 wherein said first and second flow chambers all have the same shape and size.

20. The fluid flow distribution device of claim 19 wherein said first and second flow chambers are hexagonal shaped.

21. The fluid flow distribution device of claim 19 wherein said first and second flow chamber plates are identical in construction.

22. The fluid flow distribution device of claim 19 wherein said series of orifices are arranged in a serpentine pattern.

23. A fluid flow distribution device for use in a heat exchange er having multiple heat exchange units that receive a fluid flow from a fluid inlet; the device comprising:

a pair of end plates;

a pair of flow chamber plates sandwiched between the end plates;

an orifice plate sandwiched between the flow chamber plates; and a plurality of tortuous flow paths to direct the fluid flow from the inlet to the heat exchange units, the tortuous flow paths defined by the orifice plate and the flow chamber plates sandwiched between the end plates, each of the tortuous flow paths comprising a series of orifices extending through said orifice plate, a first pattern of first flow chambers formed in one of said flow chamber plates, and a second pattern of second flow chambers formed in the other of said flow chamber plates, said first and second patterns of flow chambers aligned relative to each other and relative to said series of orifices such that the tortuous flow path extends from an initial one of the flow chambers to a final one of the flow chambers, alternating between the first and second flow chambers and passing through one of said orifices each time the tortuous flow path enters or leaves one of the first and second flow chambers.

24. The fluid flow distribution device of claim 23 wherein said first and second flow chambers of each of the tortuous flow path units are open to both sides of the corresponding flow chamber plate and are enclosed by said orifice plate on one side of each of the flow chamber plates and by the end plates on the opposite side of each of the flow chamber plates.

25. The fluid flow distribution device of claim 24 wherein:

one of said end plates has a plurality of inlet openings equal in number to the plurality of tortuous flow paths, each of said inlet openings connected to said fluid inlet and aligned with an initial one of said first and second flow chambers of one of the tortuous flow paths to direct the fluid flow from the fluid inlet to the tortuous flow path; and one of said end plates has a plurality of outlet openings equal in number to the plurality of tortuous flow paths, each of said outlet opening aligned with a final one of said first and second flow chambers of one of said tortuous flow paths and connected to at least one of said heat exchange units to direct the fluid flow from the tortuous flow path to said at least one of said heat exchange units.

26. The fluid flow distribution device of claim 25 wherein said inlet and outlet openings are not in the same end plate.

27. The fluid flow distribution device of claim 26 further comprising a pair of flow manifold plates, and wherein the end plates sandwiched between the flow manifold plates, one of said flow manifold plates including a flow path channel aligned with the fluid inlet and each of the inlet openings to direct the fluid flow from the fluid inlet to each of the inlet openings, the other of the flow manifold plates including a plurality of discrete flow path channels, each of said discrete flow path channels aligned with one of said outlet openings and the corresponding at least one of said exchange units to direct the fluid flow from the outlet opening to the corresponding at least one of said heat exchange units.

28. The fluid flow distribution device of claim 27 further comprising:

an inlet plate overlaying said one of said flow manifold plates and including an inlet port therein aligned with said fluid inlet and said flow path channel; and a header plate overlaying said other of said flow manifold plates and including a plurality of openings, each opening receiving one of said heat exchange units and aligned with one of said discrete flow channels.

29. The fluid flow distribution device of claim 23 wherein said first and second flow chambers all have the same shape and size.

30. The fluid flow distribution device of claim 29 wherein said first and second flow chambers are hexagonal shaped.

31. The fluid flow distribution device of claim 29 wherein said first and second flow chamber plates are identical in construction.

32. The fluid flow distribution device of claim 29 wherein said series of orifices are arranged in a serpentine pattern.

* * * * *